US008348022B2

(12) United States Patent
Rusanen et al.

(10) Patent No.: US 8,348,022 B2
(45) Date of Patent: Jan. 8, 2013

(54) ELEVATOR CALL DISPLAY PANEL WITH UNIVERSAL BODY PART TO ACCOMMODATE CALL BUTTON AND DISPLAY VARIATIONS

(75) Inventors: Niko Rusanen, Helsinki (FI); Timo Tiainen, Vantaa (FI); Maija Pursiainen, Vantaa (FI); Jussi Laurila, Vantaa (FI); Aapo Saari, Espoo (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 12/829,967

(22) Filed: Jul. 2, 2010

(65) Prior Publication Data

US 2011/0024240 A1 Feb. 3, 2011

Related U.S. Application Data

(63) Continuation of application No. PCT/FI2009/000024, filed on Feb. 10, 2009.

(30) Foreign Application Priority Data

Feb. 11, 2008 (FI) ..... 20080094

(51) Int. Cl.
*B66B 1/34* (2006.01)

(52) U.S. Cl. ..... 187/395; 187/391

(58) Field of Classification Search ..... 187/391–396, 187/414
See application file for complete search history.

(56) References Cited

U.S. PATENT DOCUMENTS

| | | | | |
|---|---|---|---|---|
| 5,507,366 | A * | 4/1996 | Huang | 187/395 |
| 5,679,934 | A | 10/1997 | Juntunen et al. | |
| 5,780,790 | A * | 7/1998 | Benson et al. | 187/395 |
| 6,029,778 | A * | 2/2000 | Lacarte Estallo | 187/414 |
| 6,227,335 | B1 * | 5/2001 | Koeppe, Jr. et al. | 187/414 |
| 6,502,668 | B1 * | 1/2003 | Chida et al. | 187/395 |
| 6,845,850 | B1 * | 1/2005 | Schneck | 187/395 |
| 7,021,428 | B2 * | 4/2006 | Han et al. | 187/395 |
| 7,398,865 | B2 * | 7/2008 | Felder et al. | 187/395 |
| 7,404,470 | B2 * | 7/2008 | Felder et al. | 187/395 |
| D165,896 | S | 5/2010 | Rusanen et al. | |
| 2004/0245052 | A1 | 12/2004 | Felder | |

FOREIGN PATENT DOCUMENTS

| | | | |
|---|---|---|---|
| EP | 1 584 598 | A1 | 10/2005 |
| WO | WO 00/74093 | A1 | 12/2000 |
| WO | WO 2004/050524 | A1 | 6/2004 |
| WO | WO 2007/000849 | A1 | 1/2007 |
| WO | WO 2007/046807 | A1 | 4/2007 |

* cited by examiner

*Primary Examiner* — Anthony Salata
(74) *Attorney, Agent, or Firm* — Birch, Stewart, Kolasch & Birch, LLP

(57) ABSTRACT

An arrangement for the call apparatus and display apparatus of an elevator has a body part which includes at least call buttons and other actuators, such as apertures for the display elements. The body part is essentially universal such that the number, size, shape and placement location of the apertures of the body part are arranged to be suited for the use of as many display variations and/or call button variations as possible, and in that an essentially thin light-attenuating film-like layer is disposed in front of the body part, which layer is fitted to allow light produced by the display elements through, but covers the apertures and other features in the body part.

13 Claims, 10 Drawing Sheets

ELEVATOR CALL DISPLAY PANEL WITH UNIVERSAL BODY PART TO ACCOMMODATE CALL BUTTON AND DISPLAY VARIATIONS

This application is a continuation of National Phase of PCT/FI2009/000024 filed on Feb. 10, 2009, which claims priority under 35 U.S.C. 119(a) to Patent Application No. 20080094 filed in Finland on Feb. 11, 2008, all of which are hereby expressly incorporated by reference into the present application.

BACKGROUND OF THE INVENTION

1. Field of the Invention

The present invention relates to an arrangement for the call apparatus and display apparatus of an elevator as defined in the preamble of claim 1.

2. Description of the Related Art

Elevators normally contain call apparatuses on the floor levels, such as e.g. call pushbuttons, with which a call is sent for receiving an elevator at the floor in question and correspondingly elevator cars contain call apparatuses for sending the elevator car to the desired destination floor. In addition, the floor levels and elevator cars often contain display apparatuses for displaying different information, such as at least floor information. For various reasons many structural solutions that are different both visually and in their layout are used on both floor levels and in elevator cars, which solutions comprise e.g. a different number of pushbuttons and displays as well as displays of different sizes.

A drawback with these prior-art call apparatuses and display apparatuses is that they are inflexible with respect to changes. For example, a different body part corresponding to exactly the amount of call buttons in question and to their placement is needed for each amount of call buttons, which body part comprises apertures of suitable sizes and correct positioning for the lead-throughs of the call buttons. There is also the same problem if it is desired to replace the display. The body part and other components of the apparatus are dimensioned specifically for a certain display, in which case in order to change the display to a different one, at least a body part and possibly other components of the apparatus must be changed.

BRIEF SUMMARY OF THE INVENTION

The purpose of this invention is to eliminate the aforementioned drawbacks and to achieve a simple and inexpensive arrangement for the call apparatus and display apparatus of an elevator, which arrangement can easily be configured to correspond to the needs of different buildings and of different groups of users. Additionally the purpose of the invention is to achieve an arrangement for the call apparatus and display apparatus of an elevator that enables a number of different call button layouts and display layouts and also color layouts. Additionally the purpose of the invention is to achieve an arrangement in which one, or only a few, universal, i.e. generic, body part is used, into which different call button variations and display variations can be disposed, and the shapes of the apertures and holes of which can be covered from sight.

Some inventive embodiments are also discussed in the descriptive section of the present application. The inventive content of the application can also be defined differently than in the claims presented below. The inventive content may also consist of several separate inventions, especially if the invention is considered in the light of expressions or implicit subtasks or from the point of view of advantages or categories of advantages achieved. In this case, some of the attributes contained in the claims below may be superfluous from the point of view of separate inventive concepts. Likewise the different details presented in connection with each embodiment of the invention can also be applied in other embodiments.

One advantage of the arrangement according to the invention is that call apparatuses and display apparatuses that are different in their appearance but uniform in their style are flexibly and easily achieved. Another advantage is that only one or a few universal body parts can be used, into which different call button variations, display variations and other desired functions can easily be combined. Yet another advantage is that any graphics whatsoever can be printed on the film used, so that the basic color and basic pattern of the call apparatuses and display apparatuses, as well as texts giving different information, can easily be changed if necessary. Another advantage is that various functions, such as a video camera, RFID identifiers, etc, can easily be obtained behind a covering film for the display.

BRIEF DESCRIPTION OF THE SEVERAL VIEWS OF THE DRAWING

In the following, the invention will be described in more detail by the aid of two different examples of its embodiment with reference to the attached drawings, wherein.

DETAILED DESCRIPTION OF THE INVENTION

Figure 1:
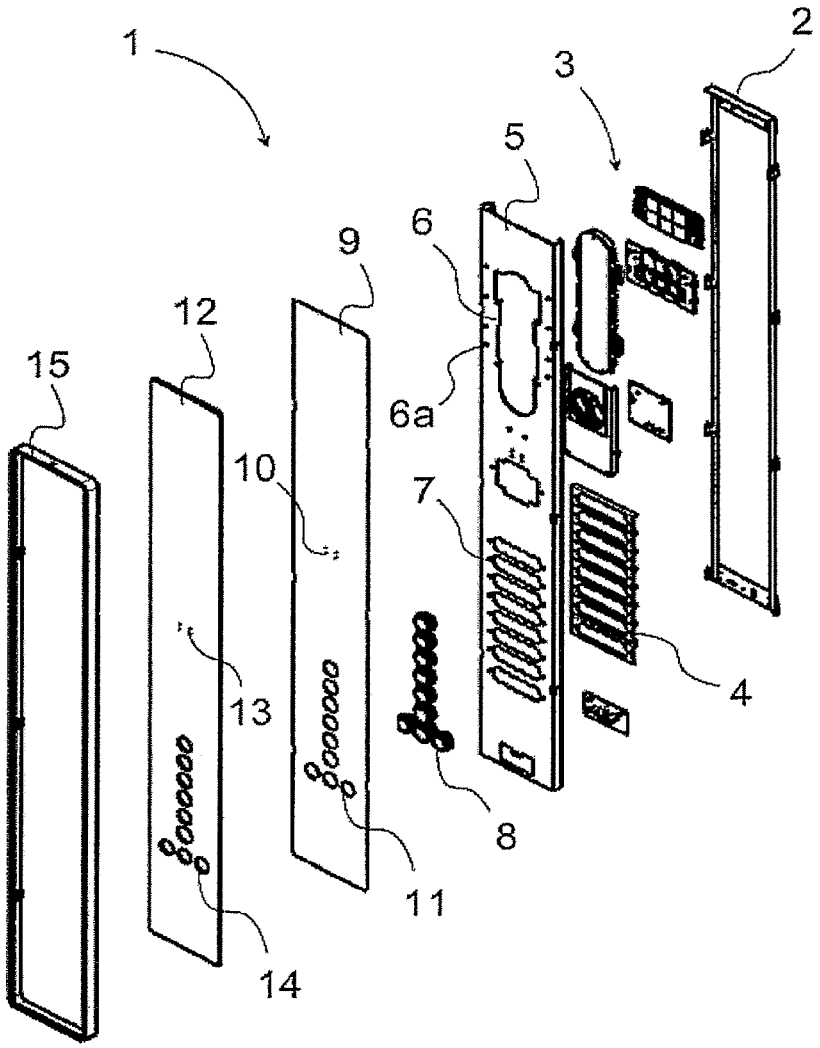
FIG. 1 presents as an explosion drawing an oblique top view of one call apparatus and display apparatus according to the invention in the elevator car.
Figure 1A:
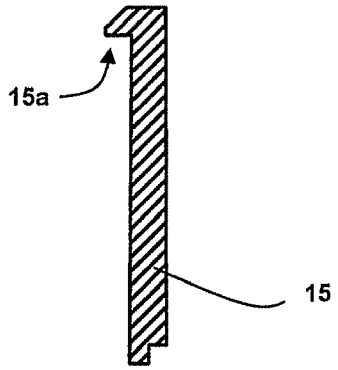
FIG. 1*a* presents a simplified cross-section of the frame.

FIG. 1 presents as an explosion drawing a partly simplified oblique top view of one call apparatus and display apparatus 1, i.e. a car call panel, according to the invention in the elevator car. The car call panel 1 comprises at least a rearmost wall fixing support 2, which is fixed to the wall of the elevator car and correspondingly in connection with which the other parts of the car call panel are fixed. The car call panel 1 also comprises an essentially supportive body part 5, which is made e.g. of metal and which comprises different apertures 6, 7 and fixing holes 6*a* for the electronics and other actuators 3 of the car call panel. The majority of the actuators 3, such as the displays, microphone, loudspeaker, fixing frames 4 of the call buttons and other corresponding actuators, of the car call panel are fixed to the body part 5 and disposed between the wall fixing support 2 and the body part 5 such that the components of the actuators 3 that are desired to be visible are visible or extend through the apertures 6, 7. For example, the call buttons 8 are fitted to extend from the apertures 7 of the body part 5 through to the front side of the body part 5. In front of the body part 5 is an essentially thin body-tinted film or thin sheet 9, which comprises apertures 10 for the loudspeaker and if necessary also for the microphone as well as apertures 11 for the call buttons 8 used in this specific application. Further, in front of the film 9 is an essentially transparent support plate 12 of corresponding size to but thicker than the film 9, which support plate comprises apertures 13 for the loudspeaker, and if necessary for the microphone, that essentially correspond to the apertures 10 and 11 in the film 9 as well as apertures 14 for the call buttons 8 used in this specific application. Outermost in the car call panel 1 is a frame 15, inside which the aforementioned components can be disposed, and which is fitted to press, with the inner surface (15*a*, FIG. 1*a*) of its front edge, the support plate 12 and all the components behind it towards the body part 5 and the wall fixing support 2, to which the frame 15 can be fixed as invisibly as possible. The frame 15 compresses the car call panel 1 to its normal operating size and surrounds it from the sides, from below and partly also from the front, thus forming a uniform package.

What is essential to the arrangement according to the invention is, among other things, that the light permeability of the film 9 in front of the body part 5 is selected suitably, taking into account the strength of the light produced by the display of the display elements that are the actuators 3, and the strength of the ambient light affecting the car call panel 1, e.g. the strength of the inner lights of the elevator car. The light permeability of the film 9 is selected to be such that the light produced by the displays of the display elements that are the actuators 3 essentially permeates the film 9, while on the other hand the ambient light affecting the car call panel 1 is attenuated sufficiently to cover the apertures and actuators behind the film 9 from the sight of the passengers in the elevator car. In this case the light produced by the display of the display element can thus be seen as more powerful than the ambient light at the same time as the film 9 covers all other features of the body part under it from the passengers, except the signs produced with the light in the one or more displays. The film 9 can be manufactured as a separate, replaceable film or it can be printed on the rear surface of the support plate (12).

As a result of the foregoing, what is further essential to the arrangement according to the invention is that the body part 5 could be made to be essentially universal, in which case only a few, or in the best case only one, body part 5 is needed for all, at least the most common, options for the number, size and placement of the actuators 3. In this case the number, size, shape and placement location of the apertures 6, 7 and fixing holes 6*a* of the body part 5 is fitted to be such that e.g. there can be one or more displays, they can be of different sizes and their placement location in the top part of the body part can within certain limits be varied. Likewise there can be a different amount of the call buttons 8 and they can be in different places than what is presented in the embodiment according to FIG. 1. The apertures 7 of the body part 5 that are made for the call buttons 8 are the width of a number of call buttons and the shape of the apertures 7 is selected such that the call buttons can be threaded through the apertures at many different points in the lateral direction. In this case the call buttons 8 can be 2, 3 or 4 or even more abreast, in addition to one vertical row. In this way different call button matrixes can be made using, however, the same body plate 5. The matrix can be e.g. two or three vertical rows of call buttons, below which is the row of three special buttons presented in FIG. 1, which special buttons are e.g. the opening and closing buttons of the doors and also a stop button. The call buttons 8 can also be disposed such that at some point above the bottom row there are more or less abreast than at the other points. In this case e.g. there can be a number of call buttons 8 for some floor that however are marked to convey to different rooms. The film 9 covers the apertures 7 that remain unused, so that the visual appearance of the car call panel 1 is always finished and neat.

The light permeability of the film 9 is influenced by the thickness and the color of the film. Generally speaking, less light passes permeates through dark colors than light colors. The film 9 can be wholly of the same color and uniform in its permeability throughout the whole area of the film or the film can also be different in its permeability in different points of the film. Differences in permeability can be implemented with different colors or e.g. with variations in the thickness of the color layer.

In addition to the permeability of light, different graphics, patterns and decorations are made on the film 9 with different colors. The car call panels 1 provided with films of different colors and different patterns can thus be fitted preferably as a visually suitable entity with respect to the other interior decor of the elevator car and/or can be selected on the basis of the wishes of customers. Different texts and other information can also be printed onto the film. For example, information concerning certain floors, and e.g. in the aforementioned case, in which a number of call buttons 8 are marked to convey to the same floor, the film 9 can be printed with the additional information applying to these call buttons.

As mentioned earlier, it is possible to conceal different actuators, which are not desired to be visible either for aesthetic reasons or for other reasons such as owing to the risk of vandalism, behind the film 9. These types of actuators can be e.g. a video camera, RFID identifiers, etc.

Figure 2:
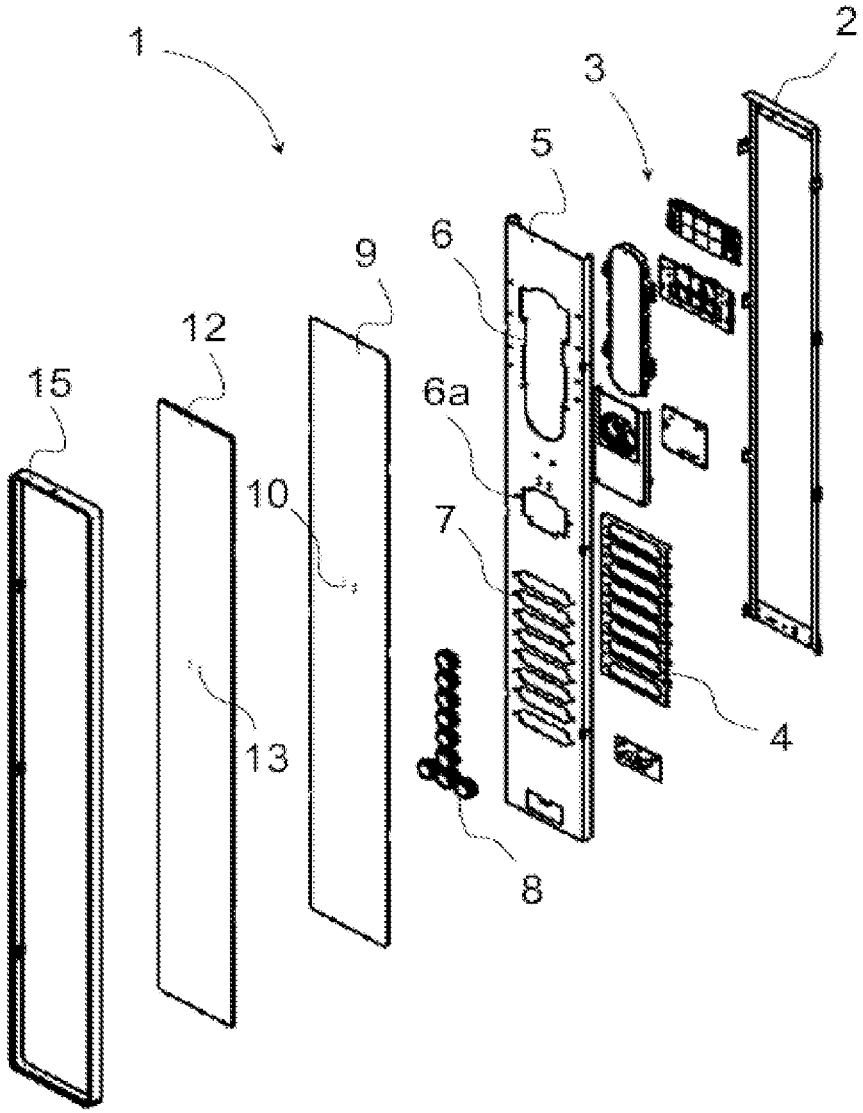
FIG. 2 presents as an explosion drawing an oblique top view of a second call apparatus and display apparatus according to the invention in the elevator car.

FIG. 2 presents a second call apparatus and display apparatus according to the invention in the elevator car, i.e. a car call panel 1. This differs from the car call panel according to FIG. 1 in that the call buttons 8 are touch buttons or call buttons that react to a light touch in some other corresponding way, which do not need to be mechanically moved, so that they are not fitted to pass through the film 9 and the support plate 12. In this case both the film 9 and the support plate 12 are intact at the point of the call buttons 8. In the manner of FIG. 1, the film 9 of FIG. 2 can be a separate, replaceable film or it can be printed on the rear surface of the support plate 9.

Figure 3:
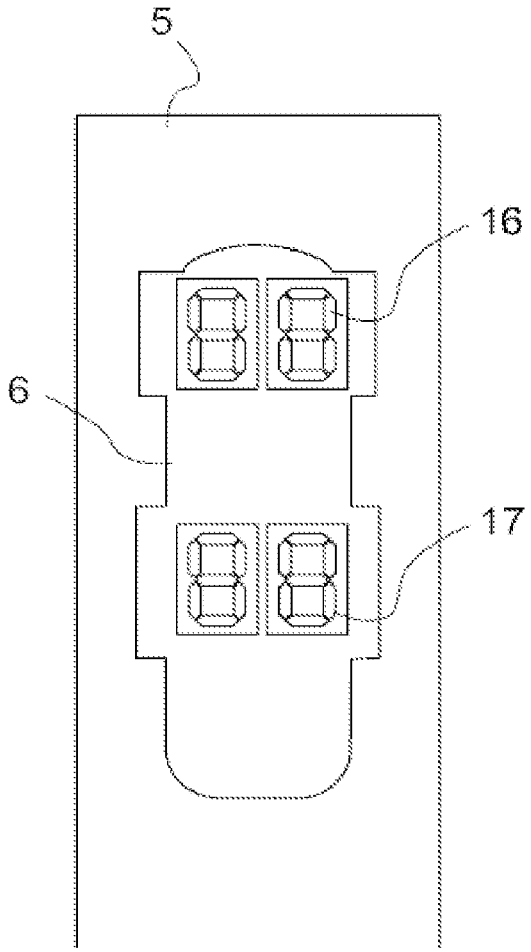
FIG. 3 presents a front view of the top end of one body part of a call apparatus and display apparatus according to the invention provided with two display elements.
Figure 4:
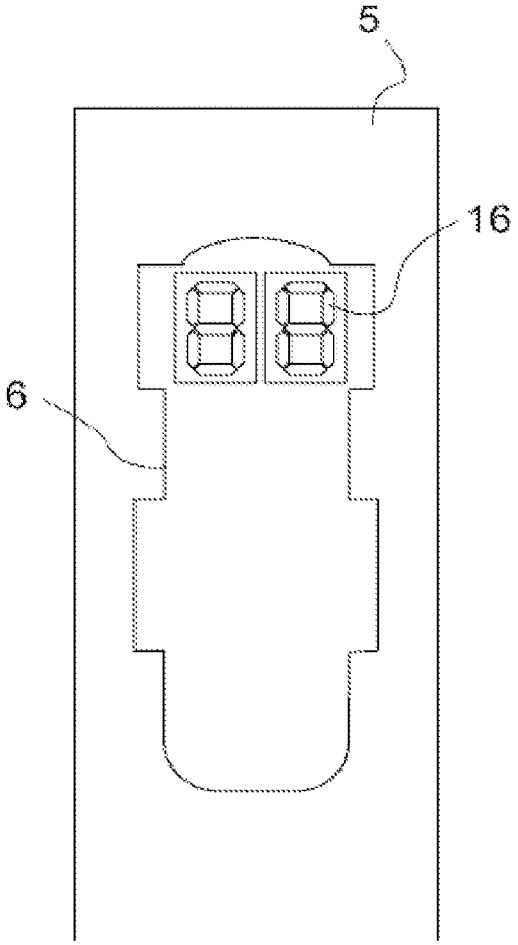
FIG. 4 presents a front view of the top end of one body part of a call apparatus and display apparatus according to the invention provided with one display element.

FIGS. 3 and 4 present two different display variations. The solution according to FIG. 3 comprises two display elements 16 and 17, one above the other, both of which are suited to the large and appropriately shaped aperture 6 in the body part 5. Correspondingly, FIG. 4 comprises only one display element 16, which in the figure is disposed in the top part of the aperture 6 but could just as well be also in the bottom part of the aperture 6. Although the display elements 16, 17 presented are similar in the figures and are based on so-called seven-segments technology, they can be also be of different models and based on different display technologies.

Figure 5:
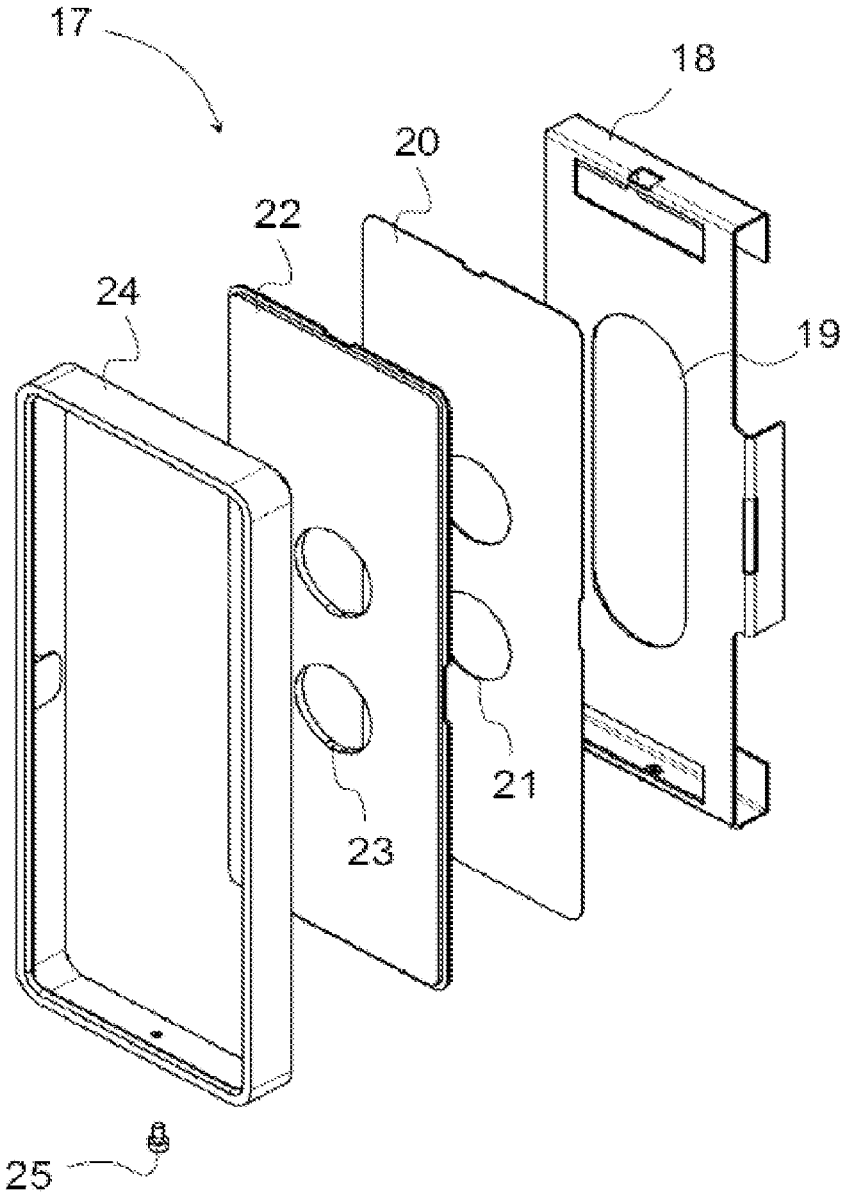
FIG. 5 presents as an explosion drawing an oblique top view of one call apparatus and display apparatus according to the invention on the floor level.
Figure 6A:
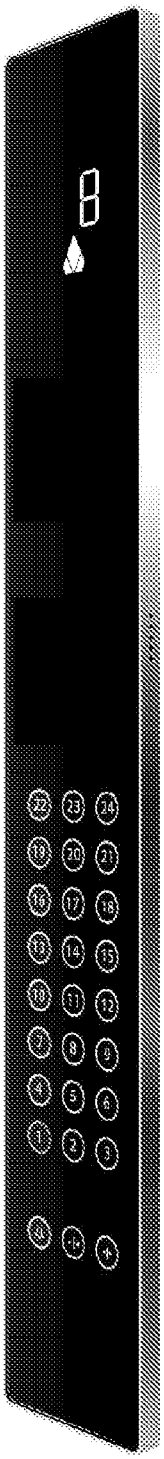
FIGS. 6*a*, 6*b* and 6*c* present an oblique side view and also a front view of a call apparatus and display apparatus according to the invention to be disposed in the elevator car.
Figure 6B:
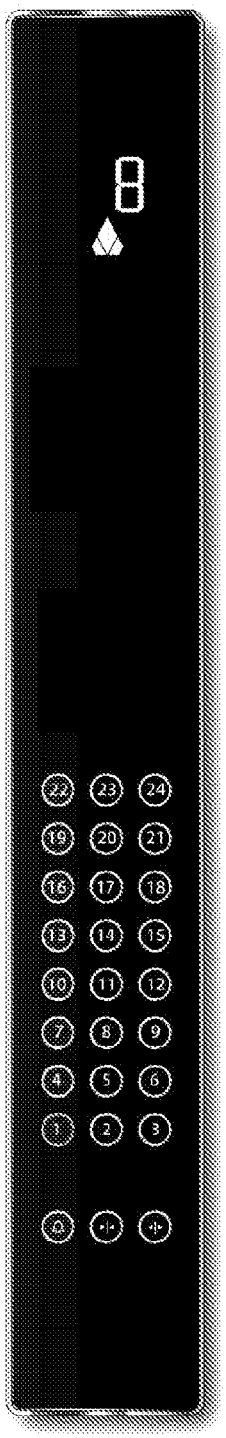
Figure 6C:
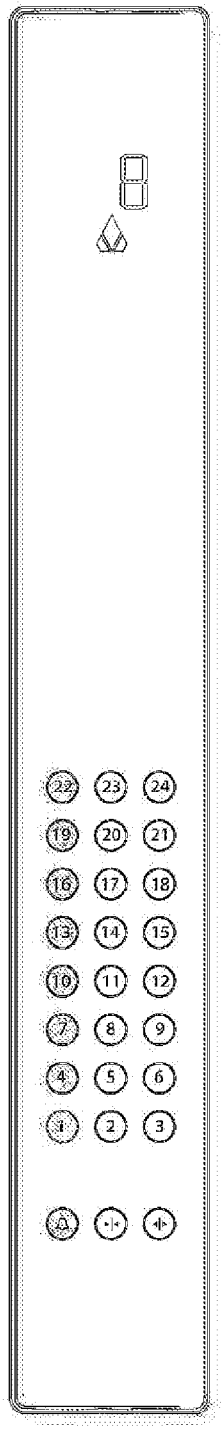
Figure 7A:
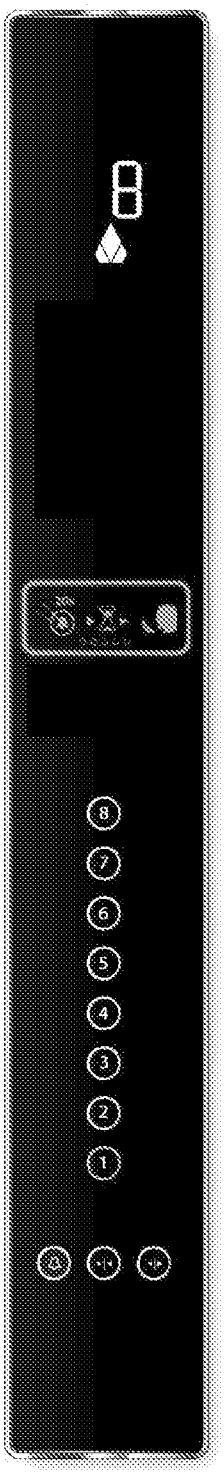
FIGS. 7*a* and 7*b* present a front view of a second call apparatus and display apparatus according to the invention to be disposed in the elevator car.
Figure 7B:
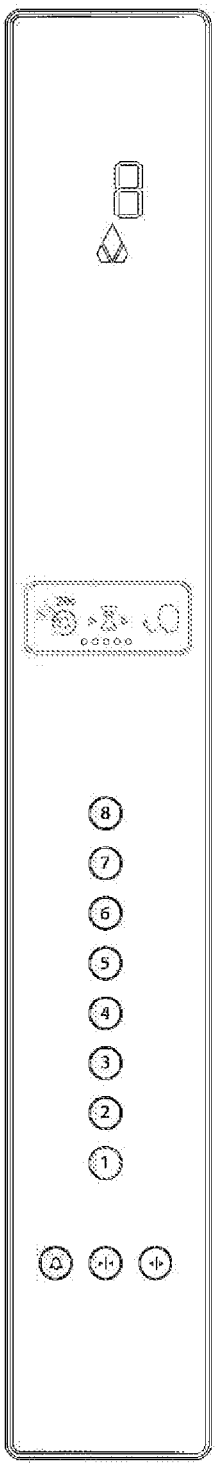
Figure 8A:
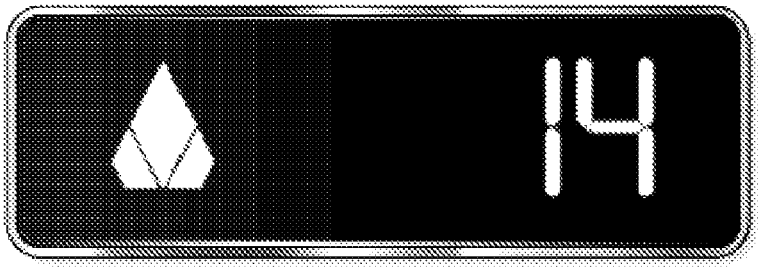
FIGS. 8*a* and 8*b* present a front view of a display apparatus according to the invention to be disposed in the elevator lobby, FIGS. 9*a*, 9*b*, 9*c*, 9*d*, 9,*e* and 9*f* present a front view of some call apparatuses and display apparatuses according to the invention to be disposed in the elevator lobby.
Figure 8B:
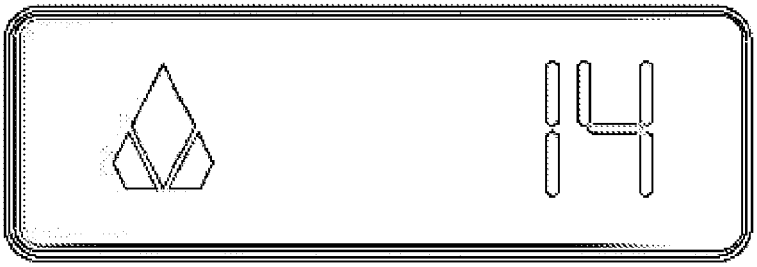
Figures 9A, 9B, 9C:
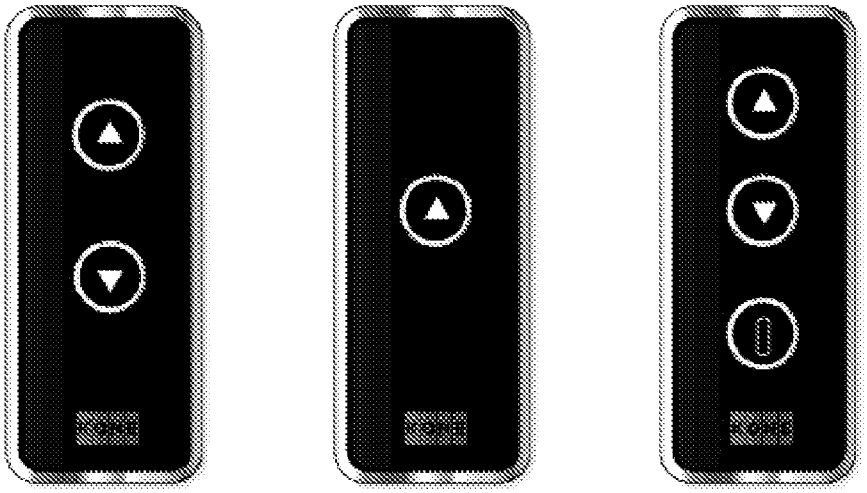
FIG. 9*g* presents an oblique side view of a call apparatus and display apparatus according to the invention to be disposed in the elevator lobby.
Figures 9D, 9E, 9F:
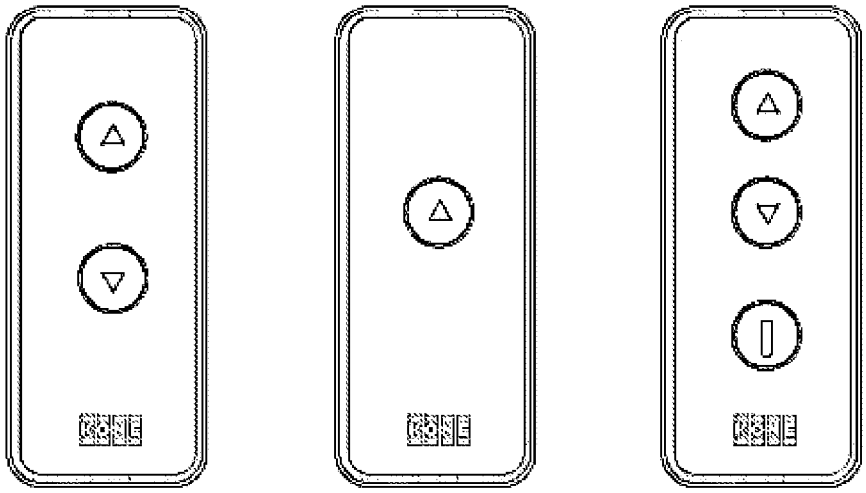
Figure 9G:
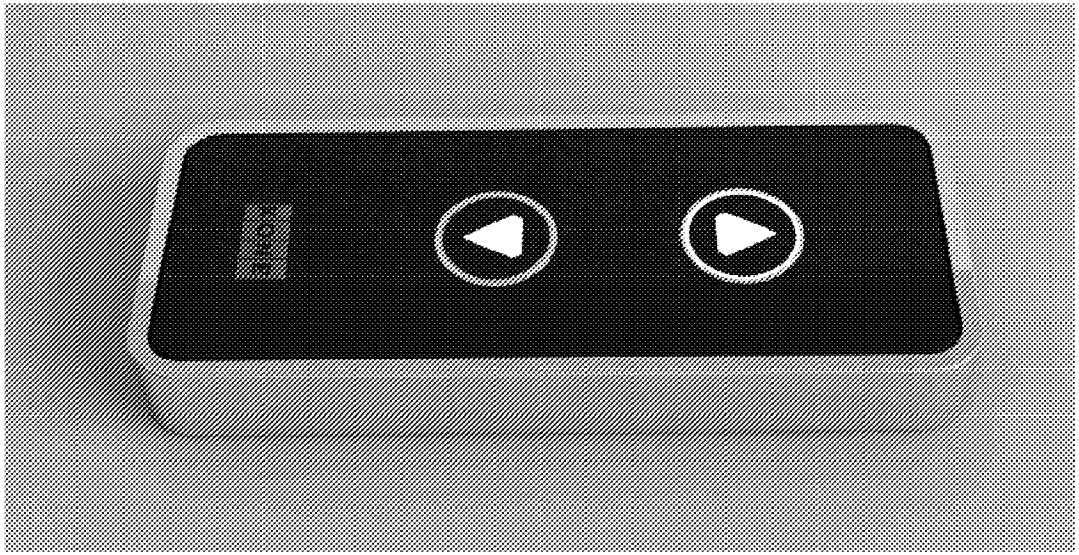
Figure 10A:
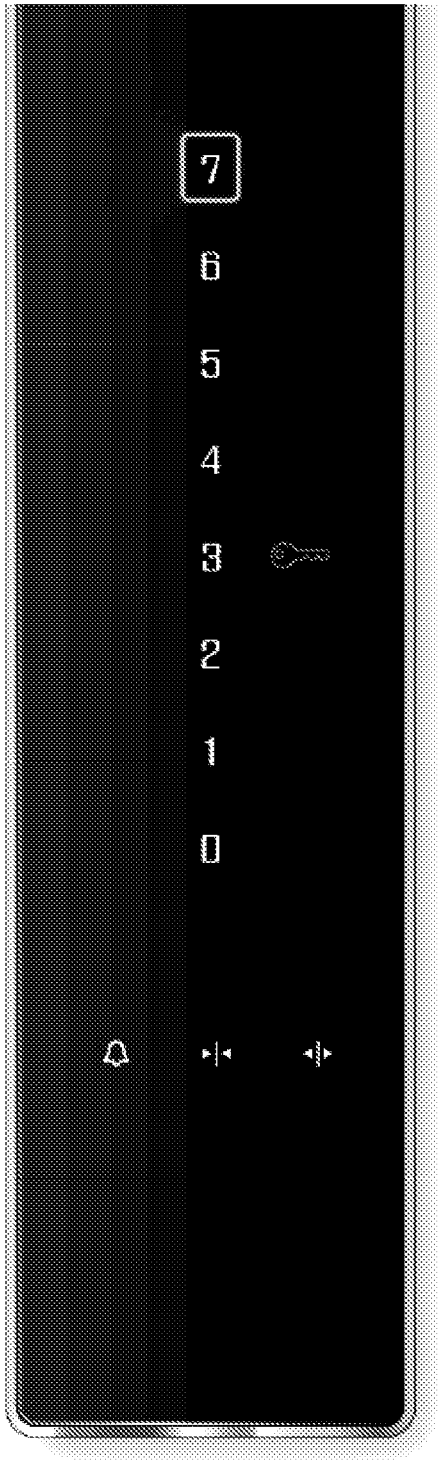
FIGS. 10*a* and 10*b* present a front view of the bottom part of a call apparatus and display apparatus according to the invention, in which the call buttons are touch buttons.
Figure 10B:
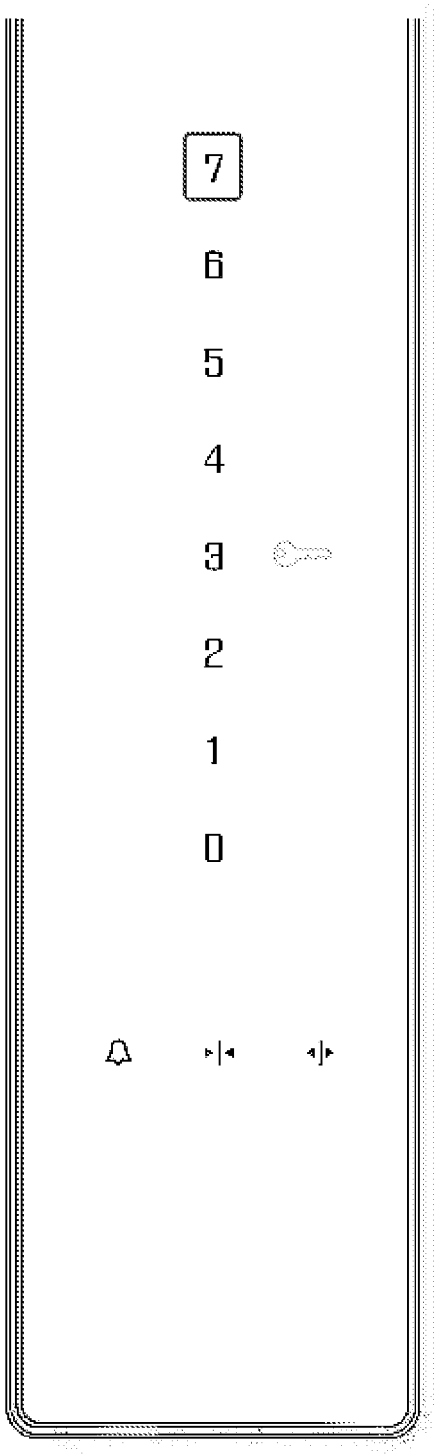

FIG. 5 presents one call apparatus and display apparatus, i.e. a call button panel 17, according to the invention in the elevator lobby, which apparatus comprises at least a universal body part 18, which comprises at least one aperture 19 for the actuators, such as the pushbuttons and indicator arrows or corresponding, of the call button panel 17. In front of the body part 17 is an essentially thin film 20 corresponding at least in its permeability characteristics to the film 9, and in front of this is an essentially transparent support plate 22 corresponding to the support plate 12. The film 20 and the support plate 22 comprise apertures 21 and 23 corresponding to the actuators disposed in the call button panel 17, which in this example are apertures intended for call buttons. Outermost in the call button panel 17 is a frame 24, corresponding to the frame 15, which is fitted to enclose the body part 18, the film 20 and the support plate 22 inside it such that only the center part of the frame 24 is open. The frame 24 is fixed to the body part 18 by means of one or more fixing screws 25 or corresponding fixing elements.

It is obvious to the person skilled in the art that the invention is not limited solely to the examples described above, but that it may be varied within the scope of the claims presented below. Thus, for example, in place of a separate light-attenuating and body-tinted film, the attenuation and graphics needed could be made with a separate color layer, which is printed either on the surface of a separate film or e.g. on the rear surface of the frontmost support plate.

The invention claimed is:

1. A call and display apparatus of an elevator, comprising:

a universal body part having a plurality of separately located apertures, wherein the number, size, shape and placement location of the plurality of apertures of the body result in the apertures framing a plurality of elevator actuators desired to be shielded from view and/or apertures framing locations that accommodate a plurality of elevator call buttons, and wherein a thin light-attenuating element is disposed adjacent to the body part, which element is adapted to transmit light produced by the elevator call button actuators desired to be viewable through the apertures, but to substantially obscure only the apertures with respect to which elevator call buttons are not associated and to obscure the apertures with respect to which other elevator actuators are desired to be shielded from view are associated in the body part.

2. The apparatus according to claim 1, wherein the body part apertures adapted to accommodate a plurality of call buttons are elongated in their lateral direction relative to their height and more than two times longer in their lateral direction than the diameter of the call buttons.

3. The apparatus according to claim 1, wherein the body part apertures have at least a size, shape, number and location such that a plurality of common elevator actuators can be fixed singly or together into the universal body part.

4. The apparatus according to claim 1, wherein the thin light-attenuating element is a separate, thin colored film.

5. The apparatus according to claim 1, wherein the tinted light-attenuating element comprises apertures for the plurality of elevator call button actuators.

6. The apparatus according to claim 1, further comprising: a transparent support plate located adjacent to the thin light attenuating element.

7. The apparatus according to claim 6, wherein the support plate comprises apertures for the number of call buttons used in a specific elevator.

8. The apparatus according to claim 1, wherein the thin light-attenuating element is printed on the surface of a film.

9. The apparatus according to claim 1, wherein the thin light-attenuating is printed on the rear surface of the support plate.

10. The apparatus according to claim 1, further comprising graphics printed on the thin light attenuating element.

11. The apparatus according to claim 2, wherein the body part apertures have at least a size, shape, number and location such that a plurality of common elevator indicators can be fixed singly or together into the universal body part.

12. The apparatus according to claim 2, wherein the thin light-attenuating element is a separate, thin colored film.

13. The apparatus according to claim 3, wherein the thin light-attenuating element is a separate, thin colored film.

* * * * *